US006866394B1

(12) United States Patent
Hutchins et al.

(10) Patent No.: US 6,866,394 B1
(45) Date of Patent: Mar. 15, 2005

(54) MODULES FOR ELONGATED LIGHTING SYSTEM

(76) Inventors: Nicholas D. Hutchins, 351 MacDonald Road, Oakville, Ontario (CA), L6J 2A8; J. Marc Hutchins, 2329 Devon Road, Oakville, Ontario (CA), L6J 5L9

( * ) Notice: Subject to any disclaimer, the term of this patent is extended or adjusted under 35 U.S.C. 154(b) by 0 days.

(21) Appl. No.: 10/089,823

(22) PCT Filed: Oct. 3, 2000

(86) PCT No.: PCT/CA00/01133

§ 371 (c)(1),
(2), (4) Date: Apr. 3, 2002

(87) PCT Pub. No.: WO01/25681

PCT Pub. Date: Apr. 12, 2001

Related U.S. Application Data

(60) Provisional application No. 60/157,484, filed on Oct. 4, 1999.

(51) Int. Cl.[7] ..... F21L 13/06

(52) U.S. Cl. ..... 362/192; 362/226; 362/238; 362/249

(58) Field of Search ..... 362/192, 226, 362/249, 227, 235, 236–238, 145–147, 152, 157, 84, 551, 555, 184, 185, 189, 190; 322/7, 40, 47, 100

(56) References Cited

U.S. PATENT DOCUMENTS

| | | | | | |
|---|---|---|---|---|---|
| 3,161,797 | A | * | 12/1964 | Butler et al. | 313/512 |
| 4,486,820 | A | * | 12/1984 | Baba et al. | 362/183 |
| 4,761,720 | A | * | 8/1988 | Solow | 362/249 |
| 5,193,895 | A | * | 3/1993 | Naruke et al. | 362/249 |
| 5,222,799 | A | * | 6/1993 | Sears et al. | 362/146 |
| 5,337,225 | A | * | 8/1994 | Brookman | 362/147 |
| 5,370,082 | A | * | 12/1994 | Wade | 362/108 |
| 5,375,044 | A | * | 12/1994 | Guritz | 362/104 |
| 5,595,441 | A | * | 1/1997 | McGee | 362/250 |
| 5,661,374 | A | * | 8/1997 | Cassidy et al. | 315/307 |
| 6,113,248 | A | * | 9/2000 | Mistopoulos et al. | 362/240 |
| 6,299,325 | B1 | * | 10/2001 | Cathel | 362/145 |

* cited by examiner

*Primary Examiner*—John Anthony Ward
*Assistant Examiner*—Ismael Negron
(74) *Attorney, Agent, or Firm*—Baniak Pine & Gannon

(57) ABSTRACT

An elongated lighted system that is modular, being of discreet length having a plurality of LEDs on an elongated support. The system has LEDs connected to a pair of electrical conductors having a length equal to, or less than the discrete length of the elongated lighting system. The elongated lighting system is molded and embedded into transparent, opaque, semi-transparent, or mixed transparent and opaque plastic module connected to an electrical source.

6 Claims, 8 Drawing Sheets

MODULES FOR ELONGATED LIGHTING SYSTEM

This application is a 371 of PCT/CA00/01133 filed Oct. 3, 2000, which claims benefit of Provisional application No. 60/157,484, filed Oct. 4, 1999.

FIELD OF THE INVENTION

The present invention relates to an elongated lighting system, preferably of discrete length, i.e., in the form of modular units. The elongated lighting system is sufficiently robust to survive being placed in a road or airport taxiway. It may have a convex, curved top surface that sheds rainwater and, in conjunction with wheeled vehicles, is self-cleaning. The elongated lighting system has light emitting diodes (LEDs), or other alternate light sources or electronics, on an elongated support which may act as a heat sink, connected to a pair of electrical conductors of length equal to or less than the elongated lighting system. The LEDs and electrical conductors are all embedded into an opaque, semi-transparent, or a mixed transparent and opaque plastic housing preferably by moulding. An electrical source may be connected externally to the plastic housing, but in another embodiment may be provided internally.

BACKGROUND OF THE INVENTION

Painted lines and other markings on the pavements are important safety devices for guiding pedestrians, aircraft, road vehicles and other modes of transportation. At night, or during heavy rainstorms, fog, snow, ice etc., there can be major problems in trying to view these markings that often apparently completely disappear. This leaves pilots and motorists confused, with difficulty in maintaining their position in relation to obstacles or other vehicles.

Elongated lighting systems are generally known. With regard to some examples, the elongated lighting system is typically in the form of a linear extrusion with encapsulated light emitting diodes (LEDs). Such lighting systems are installed in roads, airport runways and the like as a pavement inset, forming a lit guiding system for vehicles and people which reduces confusion and increases safety by making critical markings on the pavement visible in most weather conditions.

Elongated lighting systems usually require a channel support system that is embedded in or on the mounting surface and which accommodates the elongated lighting system. If used, the channel support system must protect the integrity of the elongated lighting system, permit easy installation of the elongated lighting system and, if necessary, permit repairs to be carried out.

Elongated lighting systems with LEDs are known. Examples of such systems are described in Canadian patent application 2 182 548, published Mar. 1, 1997, and Canadian patent application 2 264 886, published Mar. 12, 1998. Such systems are integrally formed with LEDs connected to a pair of electrical conductors by bus elements, all embedded in an extruded plastic material that completely encapsulates the LEDs and bus elements. The lighting systems are manufactured by feeding bus elements and circuitry with the LEDs to an extruder and co-extruding the elements and circuitry with a thermoplastic material to encapsulate and embed the bus elements and LED circuitry.

Alternative elongated lighting systems are required, especially to provide for flexibility in lighting, both as to direction and provision of semi-continuous lighting, and to permit the lighting to be embedded at or above the mounting surface as may be required.

SUMMARY OF THE INVENTION

A modular elongated lighting system with flexibility in the lighting is provided. Accordingly, one embodiment of the present invention provides a module, for an elongated lighting system, the module being of discrete length and having a plurality of LEDs on an elongated support. The module has LEDs connected to a pair of electrical conductors, the electrical conductors having a: length equal to or less than the discrete length of the module. The module is moulded with the LEDs with elongated support and electrical conductors embedded in transparent, opaque, semi-transparent or mixed transparent and opaque plastic.

Another embodiment of the invention provides a module for an elongated lighting system, the module being of discrete length and having a plurality of light emitting materials or devices, detection devices or power generating and/or storage devices on an elongated support. The module has the materials or devices connected to a pair of electrical conductors, the electrical conductors having a length equal to or less than the discrete length of the module. The module is moulded with the materials or devices, elongated support and electrical conductors embedded in transparent, opaque, semi-transparent or mixed transparent and opaque plastic.

A further embodiment of the present invention provides an elongated lighting system comprising a plurality of modules of discrete length arranged end-to-end. The modules are connected to a source of electricity provided by electrical cables disposed beneath the modules. Each of the modules have a plurality of LEDs on an elongated support, the LEDs being connected to a pair of electrical conductors having a length equal to or less than the discrete length of the module. The modules are moulded with the LEDs, elongated support and electrical conductors embedded in transparent, opaque, semi-transparent or mixed transparent and opaque plastic.

A still further embodiment of the present invention provides an elongated lighting system comprising a plurality of modules of discrete length arranged end-to-end. The modules generate electricity and light, using embedded piezoelectric devices or solar panels. Preferably the modules use embedded or external electrical storage capacity using batteries, capacitors, or other electrical storage devices. The modules have a plurality of LEDs on an elongated support. The LEDs are connected to a pair of electrical conductors having a length equal to or less than the discrete length of the module. The modules are moulded with the LEDs, elongated support and electrical conductors embedded in transparent, opaque, semi-transparent or mixed transparent and opaque plastic.

Another embodiment of the present invention provides an elongated lighting system comprising a plurality of modules of discrete length arranged end-to-end. The modules are energized by an induced voltage using an embedded magnetic core and coiled wire. The modules have a plurality of LEDs on an elongated support, the LEDs being connected to a pair of electrical conductors having a length equal to or less than the discrete length of the module. The modules are moulded with the LEDs, elongated support and electrical conductors embedded in transparent, opaque, semi-transparent or mixed transparent and opaque plastic.

BRIEF DESCRIPTION OF THE DRAWINGS

The present invention is illustrated by the embodiments shown in the drawings, in which.

DETAILED DESCRIPTION OF THE INVENTION

The present invention may be used with LEDs or other lighting or electrical or electronic elements. Examples of the latter include laser diodes, incandescent bulbs, electroluminescent strips, road condition sensors, weather condition sensors, piezoelectric devices, smart detectors of stationary vehicles or vehicle speed, axle load measuring devices, visibility detectors, and the like. In addition, light-emitting plastic compositions, polymers or organic substances may be used. Any of the above mentioned light-emitting devices can be optically controlled. In addition, the light-emitting devices may have a lens system associated therewith such as a symmetric or asymmetric, fresnel or other single or combination of lenses, or lensing devices, or lensing, holographic, micro-grooved film, or other devices for directing or partially directing the emitted light in a particular direction or pattern. Such lensing systems may be embedded, formed as part of the light emitting devices, incorporated with the other electronics or formed as part of a pattern imposed on or in the transparent, opaque, semi-transparent or mixed transparent and opaque plastic portion. The lensing system may be located adjacent to the transparent, opaque, or semi-transparent or mixed transparent and opaque plastic. The lensing system may form a portion of a cover portion.

Permanent or electrical magnets, radar reflective or absorbing materials, lights or electronics may similarly be embedded to provide guidance for machine vision, computer controlled, automated vehicles, adapted to guide themselves along highways with or without passengers. However, the present invention will be particularly described herein with respect to use of LEDs, which is the preferred embodiment.

Figure 1:
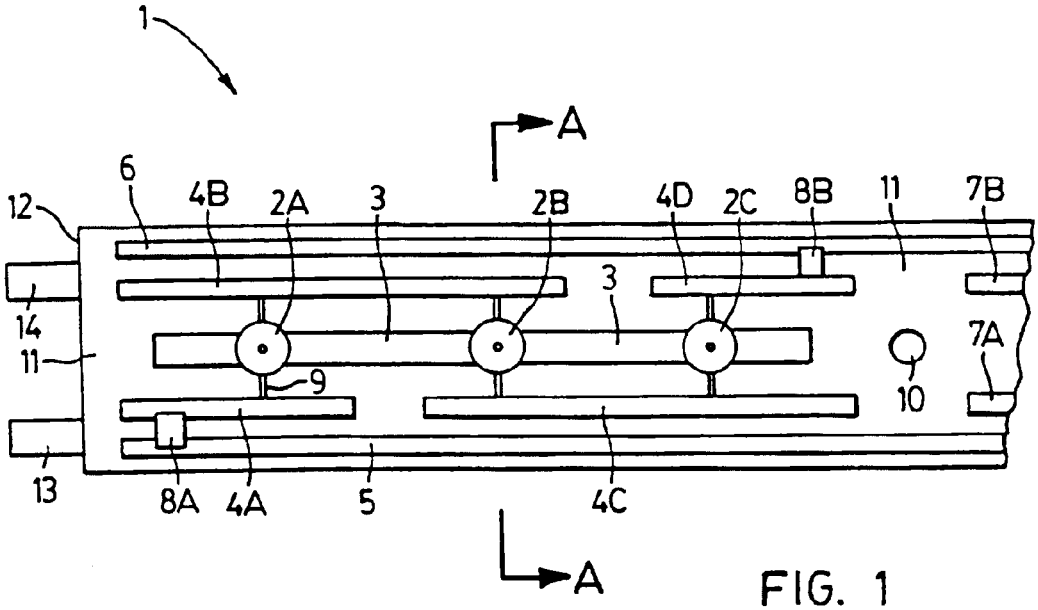
FIG. 1 is a schematic representation of a plan view of a module of the elongated lighting system.

FIG. 1 shows a module generally indicated by 1. Module 1 has three LEDs, shown as 2A, 2B and 2C. Each of the LEDs 2A, 2B and 2C are located on a support 3. Support 3 may be made of any convenient material, but is most preferably a metallic material, and especially a metallic material that will act as a heat sink. Preferably, the metallic material may be bent or moulded to allow for material expansion or shrinkage or to reduce the temperature of a particular shape, and will retain that shape. The heat sink may be desirable during manufacture to protect the LEDs against the heat during the moulding process by reducing the temperature applied to the LEDs, as discussed herein and for the longevity of the LEDs thereafter. The heat sink is also important as it may also be used to anchor the LEDs in a particular orientation during manufacture.

LEDs 2A, 2B and 2C have first electrical connectors 4A, 4B, 4C and 4D. Electrical connector 4A is connected to LED 2A through LED connector 9. LED 2A is further connected to electrical connector 4B. Electrical connector 4B is then connected to LED 28, which in turn is connected to electrical connector 4C. Electrical connector 4C is connected through LED 2C to electrical connector 4D.

First electrical conductor 5 and second electrical conductor 6 are laterally outside or distal to electrical connectors 4A–4D. First electrical conductor 5 is connected to electrical connector 4A through resistor 8A, and similarly electrical 4D is connected to second electrical conductor 6 though resistor 8B. Electrical resistors 8A and 8B may be used to control the current passing through the LEDs. Alternatively, one of resistors 8A and 8B may be a resistor and the other may be replaced with simple electrical connection. Alternatively, other components (e.g., a diode to block reverse voltage) may be substituted for the resistor, for different functionality.

As is illustrated in FIG. 1, module 1 is an elongated module. LEDs 2A, 2B and 2C are disposed down the central section of the module with electrical connectors 4A–4D located parallel to and laterally outside the LEDs. First electrical conductor 5 and second electrical conductor 6 are distal to electrical connectors 4A–4D. It will be noted that the LEDs, electrical connectors 4A–4D, first electrical conductor 5 and second electrical conductor 6 are aligned in parallel, which is the preferred arrangement, but may also be moved vertically, in that first electrical conductor 5 and second electrical conductor 6, may be located above or below the other components. All of the electrical components are embedded in transparent, opaque, semi-transparent or mixed transparent and opaque plastic 11. Furthermore, the electrical components terminate prior to end 12 of the transparent, opaque, semi-transparent or mixed transparent and opaque plastic 11, and there is no connection through end 12 to an adjacent module (not shown), unless an external end connector system is used which connects first electrical conductor 5 and second electrical conductor 6 to the next section.

It will be further noted that the LEDs 2A–2C, and electrical connectors 4A–4D, form a single unit of LEDs, and are separated from a subsequent unit of LEDs, of which only electrical conductors 7A and 7B are shown in FIG. 1.

LEDs 2A, 2B and 2C are electrically disposed in series, yet electrically in parallel in respect to other LED units or circuits. It is understood that LED circuits will be made up of a number of LEDs and although FIG. 1 demonstrates a three LED circuit, other circuits with differing numbers of LEDs and other components are also contemplated. The region between the units of LEDs is shown as having attachment orifice 10 through transparent, opaque, semi-transparent or mixed transparent and opaque plastic 11. Attachment orifice 10 is optional, and would most commonly be present to permit anchoring to the mounting surface; especially in embodiments in which the elongated lighting system would be used at least partially above a mounting surface, to permit anchoring to the mounting surface.

Figure 2:
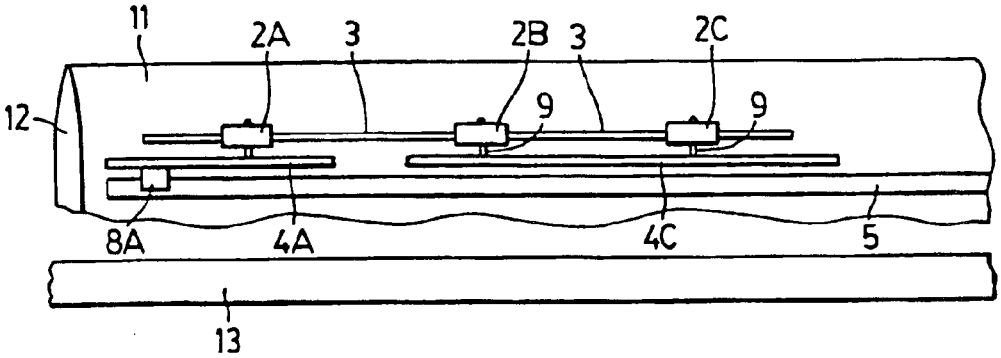
FIG. 2 is a schematic representation of a side view of the module of FIG. 1.

FIG. 2 shows a side view of the module of FIG. 1. In the embodiment of FIG. 2, the LEDs 2A–2C are shown at a higher location than that of the corresponding electrical connectors 4A and 4C and the electrical conductor 5. This is for convenience and clarity of illustration, and in practise the LEDs, electrical connectors and electrical conductors would most commonly be aligned in a coplanar arrangement, although, as previously noted, this is not essential. First electrical source conductor 13 is shown as being disposed beneath transparent, opaque, semi-transparent or mixed transparent and opaque plastic 11, and is not part of module 1.

Figure 3:
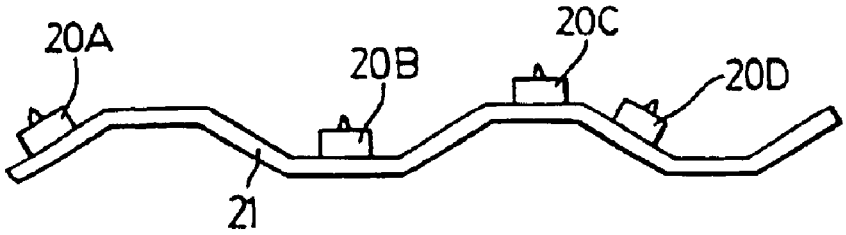
FIG. 3 is a schematic representation of LEDs on a support.

FIG. 3 shows LEDs 20A–20D located on LED support 21. In this embodiment, LED support 21 is in a non-linear shape. LED 20B is shown as being located in the trough of LED support 21, whereas LED 20C is shown as being on a peak of LED support 21. Such an alternate arrangement may be provided so that LEDs 20B and 20C provide light in different perspectives (e.g., the differences in vertically positioning of the LEDs will provide some change in the visibility of the light). LED 20A is shown on a rising section of LED support 21, oriented towards the left as viewed, and LED 20D is shown as being on a falling section of LED support 21, and thus oriented towards the right as viewed. Such LEDs would tend to shine along the length of the module i.e. axially, rather than shine directly upwards. Whilst a particular shape is shown in FIG. 3, it will be understood that many other shapes exist, both with sharp corners and/or with simple curves, which may be essential for a particular end use, or to achieve a particular light orientation. Similarly, a wedge shape or some other physical object may be used to orient the LEDs to give directionality to the light. In another embodiment a lensing system or device may be used to provide directionality or pattern to the light.

A twist may be imposed on LED support 21 so that LEDs 20A–20D illuminate away from the axis of LED support 21. Thus the LEDs may be disposed to shine directly upwards, in a longitudinal (axial) direction along the axis of LED support 21 or transverse to that axis. Such different arrangements would be used in different end uses of the elongated lighting system (e.g., roadways versus crosswalks) where the preferred directions of the lighting are different.

Figure 4:
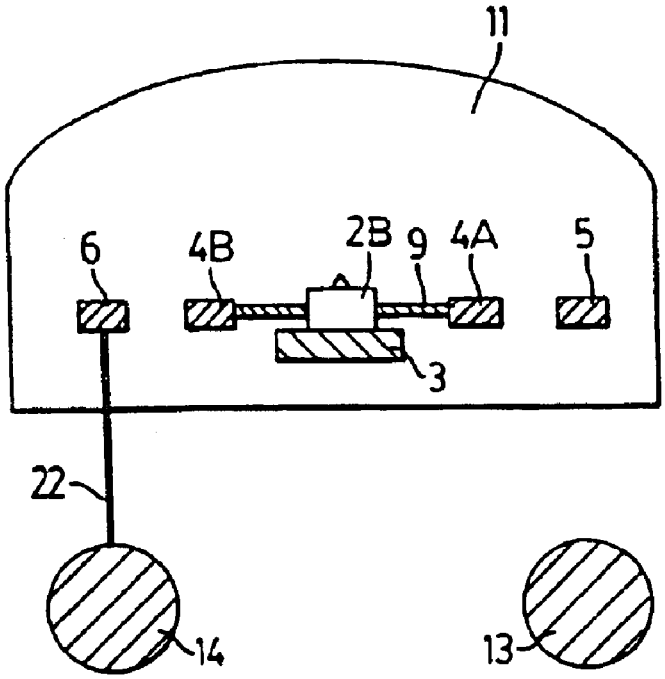
FIG. 4 is a cross-section of the module of FIG. 1, through line A—A.

FIG. 4 shows a cross section of module 1 of FIG. 1 though line A—A. In this illustration, the LEDs, electrical connectors and electrical conductors are shown in substantially a co-planar arrangement. In other embodiments the arrangement is not coplanar. In other words, the electrical conductors are offset in a vertical and/or horizontal plane. Second electrical conductor 6 is shown having connector 22 to second electrical source conductor 14. It should be understood that first electrical source conductor 13 would also have a connector to first electrical conductor 5, which is not shown in the cross-section of FIG. 4.

Figure 5:
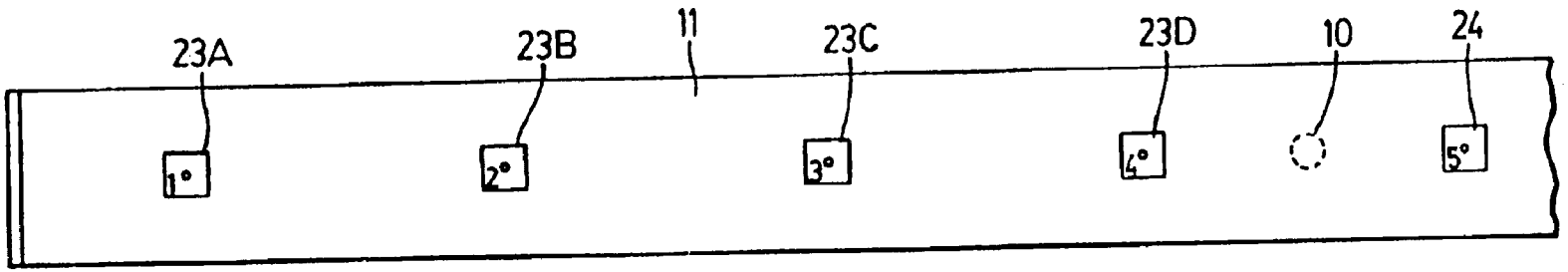
FIG. 5 is a plan view of a module of the present invention.
Figure 6:
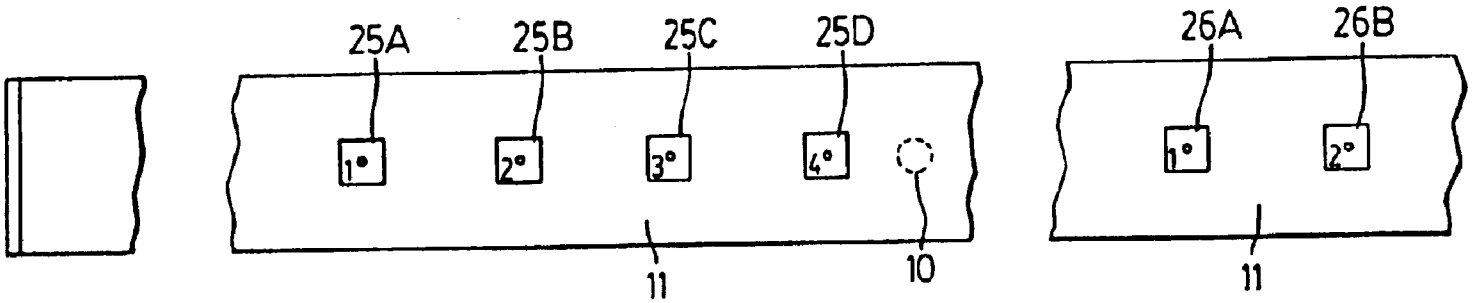
FIG. 6 is a plan view of a second module of the present invention.

FIGS. 5 and 6 show two different arrangements of LEDs within module 1. In FIG. 5, LEDs 23A–23D are in a spaced apart relationship, compared with LEDs 25A–25D of FIG. 6. In both instances, the LEDs may be separated from further LEDs in the same module by an orifice 10, which is optional. In FIG. 5, LEDs 23A–23D are separated from LEDs 24A–24D (not shown) of the same module. In FIG. 6, LEDs 25A–25D are separated from LEDs 26A and 26B of the same module. As an illustration of the different LED spacing, the spacing gap between LED 23A and 23B may be about 60 mm, whereas the spacing between LED 25A and 25B may be about 30 mm. It will be understood that any convenient spacing may be used, but differences in spacing may be used to provide different intensities of light from the elongated lighting system.

The transparent, opaque, semi-transparent or mixed transparent and opaque plastic should have a low vapour transmission rate for moisture, be stable with respect to ultraviolet light, be tough, be impact resistant, especially at low temperatures (e.g., as low as −60° C. or lower) to which the module may be subjected during use. It is understood that the plastic may contain suitable stabilizers, colours, modifiers and other chemicals to improve resistance to loading, abrasion, cuts, UV weathering, chemical attack, and/or changes to the transparency of the plastic. Examples of transparent, opaque, and semi-transparent plastics include Surlyn® ionomer resin from G.E., other ionomers, high-density polyethylene and polychlorotrifluoroethylene, and nylon. It should be understood that dyes, holographic, or grooved or etched material may be added to achieve any level of transparency.

Figure 7:
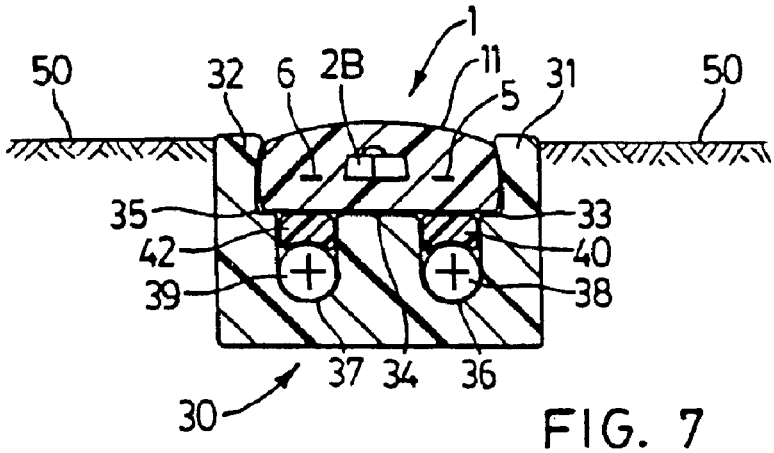
FIG. 7 is a schematic representation of a cross-section of a module of the invention in a channel system.

FIG. 7 shows a module 1 of the present invention located in a channel 30 in ground 50. Module 1 is shown in cross-section, but some parts of the module have been omitted for clarity of the drawing. Module 1 is located between arms 31 and 32 of channel 30, and supported by central support 34 and lateral or distal supports 33 and 35. Channel 30 has two grooves therein, 36 and 37, in which are located electrical source conductors 38 and 39. Electrical source conductor 38 is separated from module 1 by a filler pad 40. Similarly electrical source conductor 39 is separated from module 1 by filler pad 42. These filler pads provide support to module 1 across the gap left by the grooves. Power is transferred from the electrical conductors 38, and 39 at chosen positions using a knife-edge connector block instead of the filler pads. An alternate connector system may be an embedded cylinder within the transparent, opaque, semitransparent or mixed transparent and opaque plastic 11, pre-attached to the electronic circuit 5 and 6 of the elongated lighting system. As such, the underneath connector system would have a conductive screw type connector to bring power to the system from electrical conductors 39 and 38.

Figure 8:
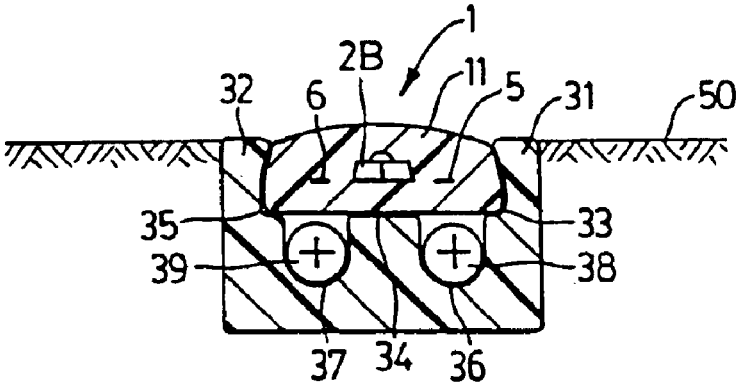
FIG. 8 is a schematic representation of a cross-section of a module of the invention in an alternate channel system.

FIG. 8 shows a module 1 located in a channel that is similar to the channel shown in FIG. 7, but in which the filler pads 40 and 42 have been omitted. FIG. 8 also shows the module in a channel in a typical end-use position, located and embedded in mounting surface 50 to a depth that corresponds with the top of the module. Such positioning of a module in a channel in the mounting surface is described herein as the preferred embodiment, useful for roads, runways and other areas. It is located in a manner that is unobtrusive to traffic using the surface, slightly below the surface such that it permits the surface to be cleared of snow, ice or the like by snowplows or brushes, which pass over it without damage.

Figure 8A:
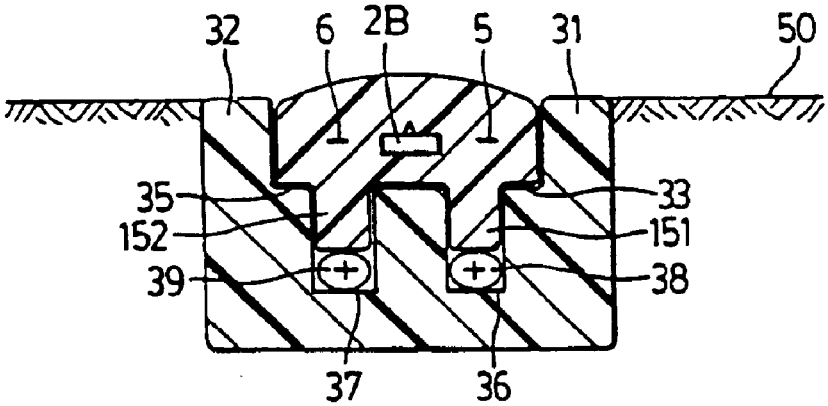
FIG. 8A is a schematic representation of a cross-section of a module of the invention in a channel system with an alternate duel locking, key shaped base.

FIG. 8A shows a module 1 located in a channel that is similar to the channel shown in FIG. 7, but in which the filler pads 40 and 42 have been omitted and module 1 has been shaped with dual legs 152 and 151 to fit into the channel. FIG. 8A also shows the module in a channel in a typical end-use position, located and embedded in mounting surface 50 to a depth that corresponds with the top of the module. Such positioning of a module in a channel in the mounting surface is described herein as the preferred embodiment, useful for roads, runways and other areas. It is located in a manner that is unobtrusive to traffic using the surface, slightly below the surface such that it permits the surface to be cleared of snow, ice or the like by snowplows or brushes, which pass over it without damage.

Figure 8B:
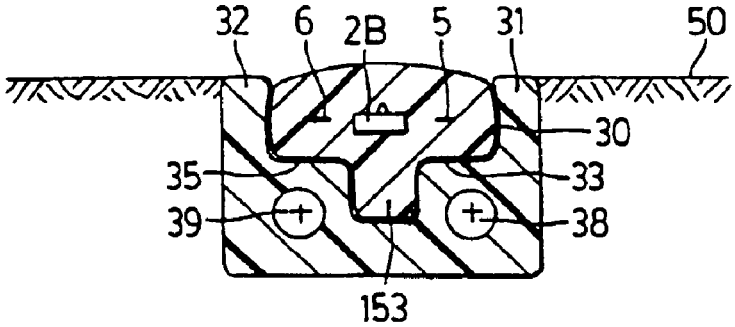
FIG. 8B is a schematic representation of an alternate channel system of a cross-section of a module of the invention with an alternate single locking, key shaped base in an alternate channel system.

FIG. 8B shows a module 1 located in a channel that is similar to the channel shown in FIG. 7, but in which the filler pads 40 and 42 have been omitted. Module 1 is located between arms 31 and 32 of channel 30, and the module 1 and distal supports 33 and 35 of channel 30 have been elongated so module 1 rests on these sections. Module 1 has also been shaped with a single leg 153, to fit into the channel, which has electrical source conductors 38 and 39 embedded in channel 30. FIG. 8B also shows the module in a channel in a typical end-use position located and embedded in mounting surface 50 to a depth that corresponds with the top of the module. Such positioning of a module in a channel in the mounting surface is described herein as the preferred embodiment, useful for roads, runways and other areas. It is located in a manner that is unobtrusive to traffic using the surface, slightly below the surface such that it permits the surface to be cleared of snow, ice or the like by snowplows or brushes, which pass over it without damage.

Figure 9:
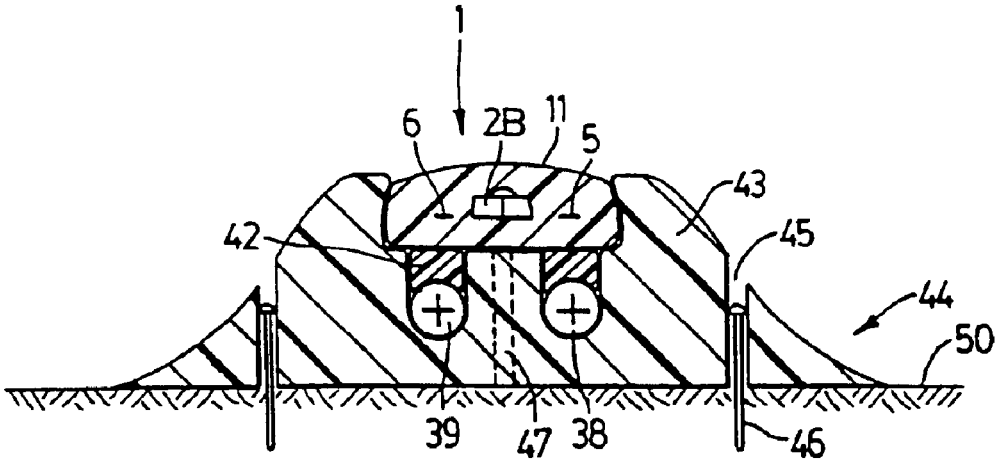
FIG. 9 is a schematic representation of a cross-section of a module of the invention in a further alternate channel system.

FIG. 9 shows a module 1 in a channel system that is similar to that of FIG. 7, except that the channel is intended to be located above the mounting surface 50. In this embodiment of the channel, arms 43 taper towards the mounting surface 50, and provide a smooth transition at 44 with the mounting surface 50. In this manner, module 1 may be located above the mounting surface level, particularly in a temporary manner with the channel providing for ease of movement of vehicular traffic over module 1. A variety of degrees of taper may be used, with varying ease for passage of traffic over the module.

In the embodiment of FIG. 9, the channel is shown as being anchored to the mounting surface through orifice 45 using pin 46. As an alternative, a pin may be placed through orifice 47, which is a centrally located orifice within the channel. Orifice 47 would normally be located such that the pin may be passed through orifice 10 of module 1, as shown in FIG. 1, through orifice 47 of the channel to anchor the system to the ground.

The embodiments shown in FIGS. 7, 8, 8A and 8B illustrate the invention in a channel system embedded in the ground. A groove is cut in the ground surface at a width and depth sufficient for the channel support system to be inserted in the ground. It is understood that arms 31 and 32 would typically be at a level with, or slightly below the ground, so that vehicles may readily pass over the elongated lighting system. In particular, snow-clearing vehicles at airports and on roadways need to be able to pass over the elongated lighting system without the blades from such vehicles snagging on the channel support system.

In the embodiments shown in FIGS. 7, 8, 8A and 8B, the channel support system is placed within the groove in the ground surface, and held in place. For example, this may be done mechanically by drilling a hole through the complete system and inserting fasteners (e.g., flush mounted expansion bolts) using hard setting epoxy, or other systems disclosed herein and/or by having adhesive underneath to assist with retention of the channel support system within the groove in the ground.

In the embodiment shown in FIG. 9, the channel support system may be partially embedded within a groove in the ground or mounted above ground level i.e. located on the surface of the ground. If the channel support system is partially embedded, it may be held in place by methods described above for the embedded system. Alternatively, and especially when located completely above ground level, the channel support system may be anchored in position using spikes or other means that pass through the channel system, with a flush or recessed fitting with the channel system, to anchor the system to the ground. The tapered sections (see, e.g., 44) would normally be anchored, using fasteners (e.g., chemical and/or mechanical fasteners).

It is understood that the tapered sections 44 may be used with any embodiment shown herein. Indeed in the embodiment shown in FIG. 9, the elongated lighting system may be partially embedded within a groove in the ground or mounted above ground level, i.e., located on the surface of the ground. If the elongated lighting system is partially embedded, it may be held in place by methods described above for the embedded system. Alternatively, and especially when located completely above ground level, the elongated lighting system may be anchored in position, with or without an accompanying U channel, using spikes or other means that pass through the system, with a flush or recessed fitting with the system, to anchor the system to the ground. The elongated lighting system may be made with tapered sections (see, e.g., 44) that would normally be anchored, using fasteners (e.g., chemical and/or mechanical fasteners).

Figure 10:
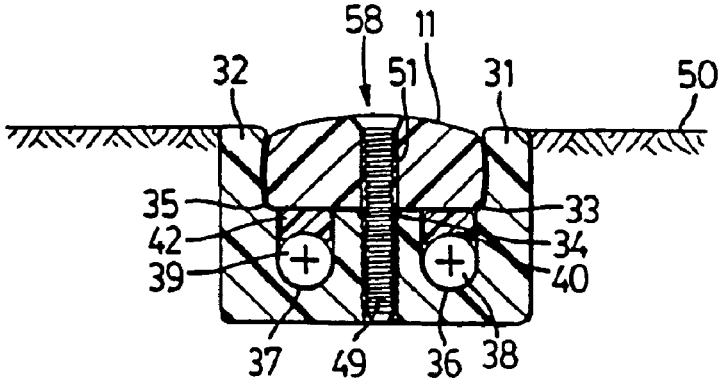
FIG. 10 is a schematic representation of the embodiment of FIG. 7 anchored in ground.

FIG. 10 shows the embodiment of FIG. 7 with screw orifice 49 in the channel system, screw orifice 51 in the lighting system and screw 53 inserted therein. It will be noted that screw 53 is flush with the upper surface of the lighting system, but it may be recessed. It will be noted that LEDs 2B and electrical connectors 5 and 6 are absent, as screw orifice 51 is located between units of LEDs.

Figure 11:
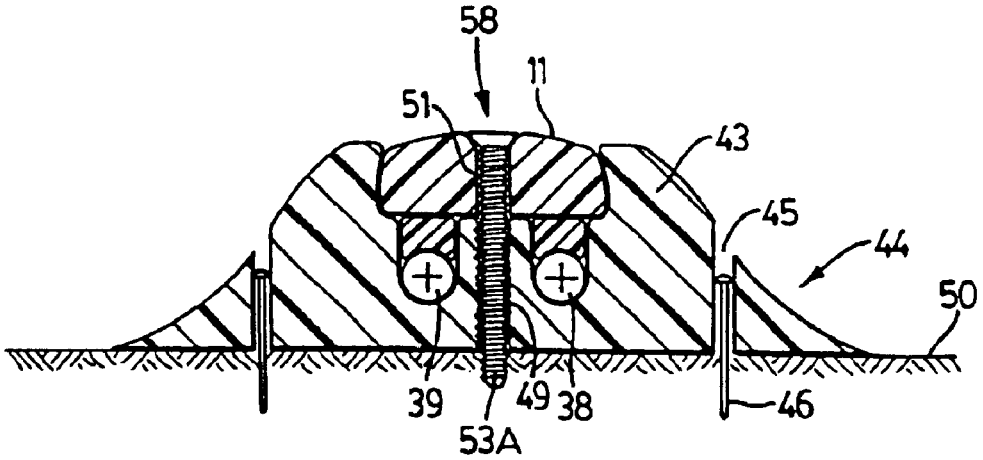
FIG. 11 is a schematic representation of the embodiment of FIG. 9 anchored to the ground.

FIG. 11 shows a similar system in the embodiment of FIG. 9 (i.e. with the system above ground). In FIG. 11, screw 53A in screw orifice 51 extends through the housing. In FIG. 10 discussed above, screw 53 does not. Screw 53A is in use in anchoring the channel system of FIG. 11. In FIG. 10, screw 53 is in use in attaching the elongated lighting system to the channel system. One or both types of screw systems would be used, depending on the particular end-use.

The present invention has been particularly described herein with reference to use of a channel support system having a pair of spaced apart grooves in which electrical conductors are located. However, one groove may be provided, with both electrical conductors therein, or more than two grooves may be provided so that additional wiring or cable may be installed.

The channel support system may be formed from a variety of materials. For instance, the channel support system may be formed from rubber materials including recycled rubber EPDM (Ethylene-Propylene-Terpolymers Rubbers), EPM (Ethylene-Propylene-Copolymer Rubbers), neoprene, stainless steel, titanium, nickel coated steel, or any other non-corroding metal or plastic. These need to be of sufficient hardness and corrosive resistance to withstand normal use in the particular location of use.

The channel support system may be made of a variety of techniques, especially moulding and extrusion. For instance, if the channel support system has a degree of flexibility, the channel support system may be extruded in continuous lengths and stored on rolls prior to installation. In this manner, a long length of channel support system may be installed, and modular lengths of an elongated lighting system subsequently installed. However, in other embodiments, the channel support system is moulded or extruded in a modular length, and in particular in a modular length that corresponds to the modular length of an elongated lighting system.

Figure 12:
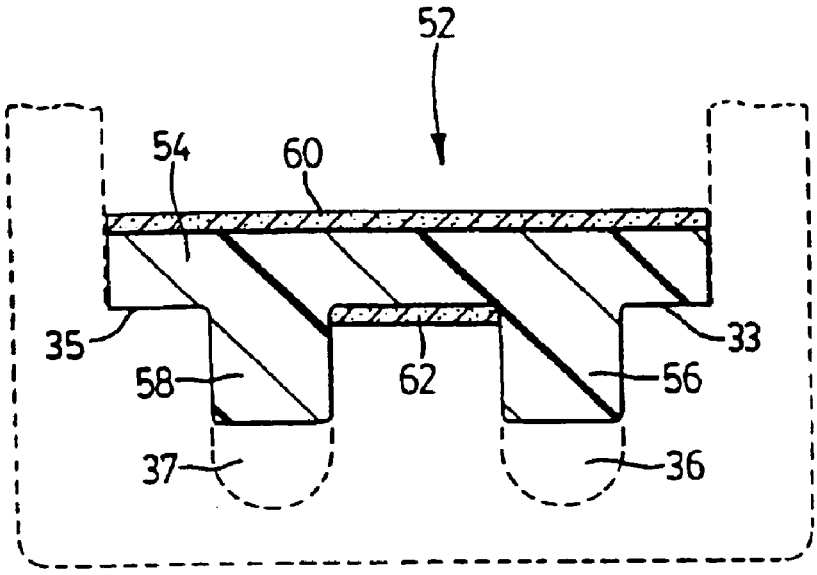
FIG. 12 is a schematic representation of a cross-section of an alternate filler pad.

FIG. 12 shows an alternate embodiment of a filler pad, known as a packer and generally indicated by 52. Packer 52 is shown located within a channel system, shown in dotted lines. Packer 52 has upper plate 54, which rests on distal support member 33 and 35 of a channel support system. Upper plate 54 has two legs 56 and 58 that extend downwards into grooves 36 and 37, respectively. Legs 56 and 58 extend only partially into grooves 36 and 37, to permit electrical conductors (not shown) to be located in grooves 36 and 37 as described herein.

Packer 52 is shown with upper adhesive strip 60 and lower adhesive strip 62. Upper adhesive strip 60 facilitates retention of an elongated lighting system on packer 52. Lower adhesive strip 62 facilitates retention of packer 52 in a channel system.

Packer 52 would be made of a material that will support, cushion and hold the module 1 in place.

Figure 13:
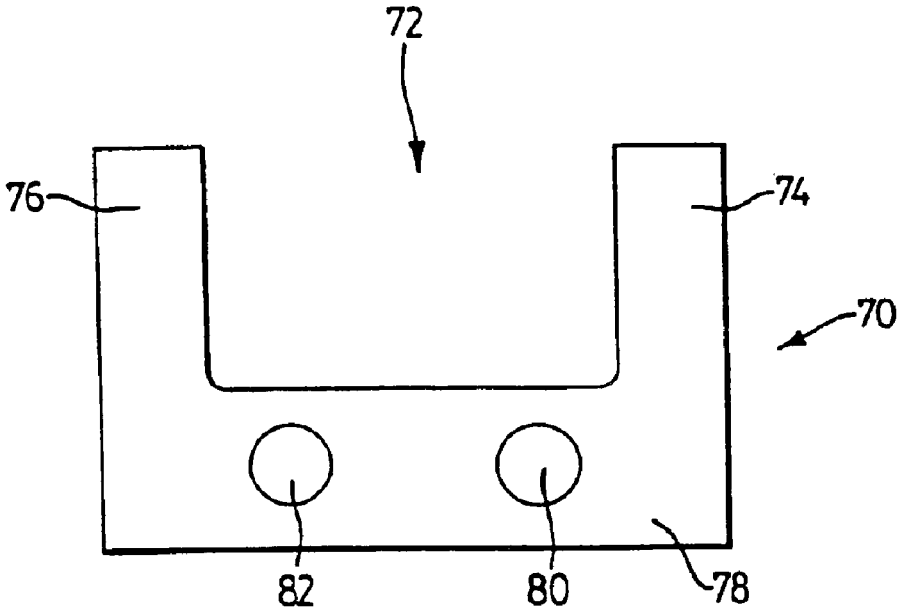
FIG. 13 is a schematic representation of an alternate channel system for the modules of the invention.

FIG. 13 shows an alternate embodiment of a channel system. U-shaped channel 70 has recess 72 that would accommodate an elongated lighting system. Arms 74 and 76 of U-shaped channel 70 and base 78 form recess 72. Base 78 has two electrical conductors 80 and 82 embedded therein. Electrical access to electrical conductors 80 and 82 would be by penetration of base 78. U-shaped channel 70 may be provided with distal support members (not shown), to provide for a filler pad or packer of appropriate shape to be inserted (e.g., to provide cushioning or other effects for the elongated lighting system). U-shaped channel 70 may be provided with a connector system at each end thereof.

The channel system may be a conduit for other wires or for fibre optic cable utilized by the module, or may provide a right of way for said wires, fibre optics or cable. An additional groove may be required to accommodate such wires or cable.

The channel system may also be provided with a base suitable for attachment to a particular mounting surface. For instance, if the surface was steel (e.g., the deck of a ship) a steel base or channel may be provided or the material of the channel selected or treated to enhance adhesion to the mounting surface.

In embodiments of the invention, the channel system has a roughened or keyed surface for retention of modules. In particular, the modules and channel system have co-operative keying elements to assist in retention of the modules.

One advantage of the channel system is that it allows for relatively easy access to the coated electrical conductors 25 and 24, so replacement of modules of the elongated lighting system can be readily carried out.

The channel system, including an elongated lighting system of the invention, provides a protective shell for the electrical power distribution for the lighting. This is especially useful in environments that impose high physical or other demands on the system, including use on roads. The system also provides quick and easy accessibility to the electrical power conductors, without digging for recovery, permitting maintenance or up-grades of the system that are less time consuming and less disruptive to users.

The channel system used in association with the lighting system of the invention needs to be adapted to the particular end-use. In particular, the channel should be sealed to the ground (e.g., road) whether concrete, asphalt or other surface. The channel system also assists in excluding water from the lighting system. A continuous groove also alleviates potential problems. In embodiments of the invention, particularly where the end-use is outside (e.g., in a road or runway) the channel system is provided at intervals with a groove, slot, orifice or the like to permit relief from any water pressure that should occur within the channel system or exterior thereto in the groove cut into the ground surface.

In addition, the channel system should provide cushioning when loaded (e.g., when a vehicle passes over the channel system and the elongated lighting system). The channel system should also allow the lighting to be removed if road repairs are required, while providing secure anchoring for the system.

Electrical power connection from below the light system permits multiple power connections for redundancy and repair. It also increases the electrical connection. For example, during use, the weight of a vehicle would tend to urge the light system downwardly potentially improving the electrical connection. Different sizes of filler or packing permit use of wire of different diameters.

The modules disclosed herein are manufactured in a moulding process, as this permits flexibility in manufacture. While a multi-stage moulding process may be used, a single stage process is preferred. The electronic circuitry is placed into the cavity of a mould of an injection moulding apparatus, and held in position in the mould. Molten thermoplastic polymer is injected into the cavity to fully encapsulate the electronic circuitry.

The LEDs are temperature sensitive, and exposure to high temperatures can lead to degradation or degeneration of the LEDs, and consequent loss of useful life or even failure. Thus, the thermoplastic polymer needs to have a relatively low melting point, consistent with the other required properties of the plastic (e.g., clarity, toughness etc.). The heat sink described herein assists in reducing the temperature to which the LED is subjected and/or decreases the time that the LED is at the maximum temperature that the LED attains.

In another embodiment, the electronic circuitry includes contacts for providing electricity from the electrical supply conductors. These contacts would then act as supports while the circuitry is in the cavity. Alternatively, the contacts may be in the form of a pin that is gripped by the mould or recessed into an orifice with the mould, from the moulded part.

Encapsulation of the electronics of the module in a single piece, solid, transparent, opaque, semi-transparent or mixed transparent and opaque plastic matrix provides an enclosure for the electronics that it is safe from environmental effects. In a preferred embodiment as disclosed herein, the electronic circuit is mounted on a platform ribbon made of the same material as the plastic used in the encapsulation. During an injection moulding process, the ribbon melts and blends into the melt that is injected in the injection moulding process, so that no layers are formed within the module, although an interface line might exist. The molten plastic flows around all components to give complete encapsulation.

As alternatives to injection moulding, extrusion or casting or other forming techniques may be used, depending on the particular components of the lighting system. For instance, a base having electrical conductors and modules of components may be embedded within a linear plastic moulding, and subsequently mated with modular lighting, intelligent or smart sensors or communicating devices, to be customized to a particular end-use.

In other embodiments, the circuits are set down on hard circuit boards made from traditional materials attached to the electrical conductors 5 and 6.

In alternate embodiments, the plastic under the LEDs may be opaque, translucent or be reflective. For example, such plastic may contain flake aluminium, glass beads, luminescent or coloured paint, lenses, holographic, microgrooved film, or other devices or other material with light guiding or reflective properties to enhance visibility.

In alternate embodiments, there may be a moulded section of plastic without any electronics or LEDs embedded within it, which would act as a passive "blank" or "filler". This "filler" may be opaque, translucent or be reflective. For example, such plastic may contain flake aluminium, glass beads, luminescent or coloured paint, lenses, holographic materials or devices, microgrooved film, or other devices and material with light guiding or reflective properties. Such a "blank" system would be used as a "filler" for areas that do not require active electronics or LEDs, as on roads, airfields or helicopter pads, where continuous lit markings are not desired, and where a dashed, broken, or skip line marking is required. A continuous channel would be installed, with intermittent active and passive elements.

With the active systems, the LEDs may be further mounted on a support, which should be a metallic support that will act as a heat sink. In addition, the support may be fabricated so that it may be twisted, bent or otherwise shaped to provide for differences in the directionality of the LEDs. While the support may be continued for the full length of the module, it may be more convenient to utilize short lengths corresponding to the units of the LEDs. In this way, sections of the module may be attached to a mounting surface between various units of LEDs, modules may be cut through at such point, or different orientations of LEDs may be provided in the same module. It will be appreciated that the length of the modules may be varied, including by being severed between units of LEDs, as the electrical source conductors are located underneath the plastic material of the module. Thus, there is no need for any type of connector between modules.

The support provides a heat sink for the LEDs during fabrication, as well as during operation. In both instances, this protects the LED from excessive heat and premature degeneration of the life of the LED.

The plastic should preferably be a plastic that will bond to the metal of the electrical conductors and the support, to assist in ensuring waterproof integrity of the module so that water does not migrate along the interface between the metal and the plastic.

Each unit of LED lamps is wired in parallel and is independent of the next unit of LEDs within the module. Thus, any failure of any electrical connection or LED within a unit of LEDs does not affect the operation of other units of LEDs within the same module, or within any other module that is being used.

The circuit component used in the manufacture of the modules of the present invention must be capable of being subjected to the fabrication process, and still be capable of functioning in an acceptable manner, especially exhibiting a long life with minimal maintenance. The physical and other demands placed on the circuit component during the manufacturing process will vary depending on the particular type of process that is used.

In one embodiment, a linked wire construction may be used for the circuit component. In this construction, the wire is in the form of copper traces laid down on a ribbon of a plastic composition. Preferably, the plastic composition of the ribbon is the same composition that is used for the remainder of the moulding, so that a good bond between the ribbon and the remainder of the plastic composition may be achieved during the moulding process (e.g., the two parts are bonded in a substantially leak-free manner). The required electrical circuit may be made by cutting the trace as required, to form an electrical break in the circuit and thereby creating a base circuit board. A punch, water cutter, laser cutter, vibration cutter, or other mechanical means may be used to obtain such cuts. Individual sections of the circuit would then be linked by components or other connections. A heat sink may be attached to the base plastic ribbon, ready to be formed into the desired shape after the components have been attached, as discussed herein.

Figure 14:
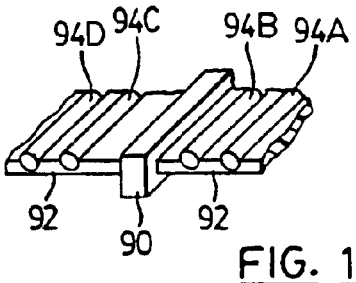
FIG. 14 is a schematic representation of wiring on a ribbon.

As an alternative, multiple strands of wire may be used on a base, with the circuit being formed by connection to the strands in an appropriate manner. The strands may be on a ribbon or other base, preferably formed from the same polymeric composition as is to be used in the moulding process, to ensure effective encapsulation, or may be inside a jacket material with the multiple wire runs pre-joined together into a "flex." An example of the multiple strands of wire, shown with a heat sink, is shown in FIG. 14. FIG. 14 shows heat sink 90 with ribbon 92 attached thereto. Wires 94A, 94B, 94C and 94D are located on ribbon 92.

As a further alternate, a miniature circuit board capable of withstanding the moulding process may be fabricated for the mounting of the components. The circuit board would need to be small, in order to not adversely impede the flexibility of the system disclosed herein. The board may be made from traditional materials fixed to the traces by the use of solder or by mechanical means (e.g., crimping or pinning).

Figure 15:
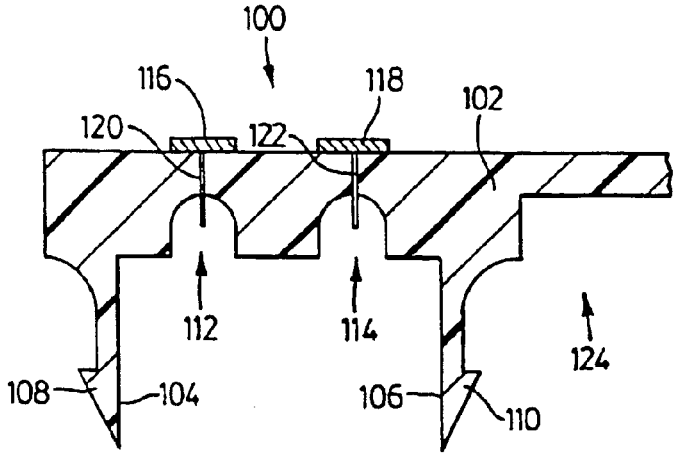
FIG. 15 is a schematic representation of a locking module for use with the modules of the invention.

In another alternative, a two-part locking module may be used to make the connections in the circuit and to form a soldering base for the components of the; circuit. An example of half of such a locking module is given in FIG. 15. Locking module 100 is shown in cross section and in part, the other part being for example a mirror image (female and/or male) of the part illustrated.

Locking module 100 has base 102 from which legs 104 and 106 extend downwards. Legs 104 and 106 have locking teeth 108 and 110 thereon, which are intended to lock into corresponding recesses in the opposite (female) half. Intermediate, between legs 104 and 106, are notches 112 and 114, cooperatively located with solder pads 116 and 118 located on the upper surface of base 102. Pins 120 and 122 extend between solder pads 116 and 118 and notches 112 and 114, respectively, for electrical connection to an electrical conductor (not shown). A heat sink cavity 124 is located adjacent leg 106.

A variety of means of connecting the electrical connectors to the electrical source conductors may then be used, some of which are discussed above. In a preferred embodiment, a connection may be built into the lower surface of the module, from the electrical conductor, during the moulding of the conductor. Subsequently, during use, electrical connection is made using suitable conductive padding, pins, spikes or other arrangements through the coating of the electrical conductors to provide the appropriate isolated, weather proof, electrical connections. In this manner, multiple connections may be made in this manner from each module to the electrical source conductors, to provide for a redundancy of connections in the event of failure of one such connection.

Figure 16:
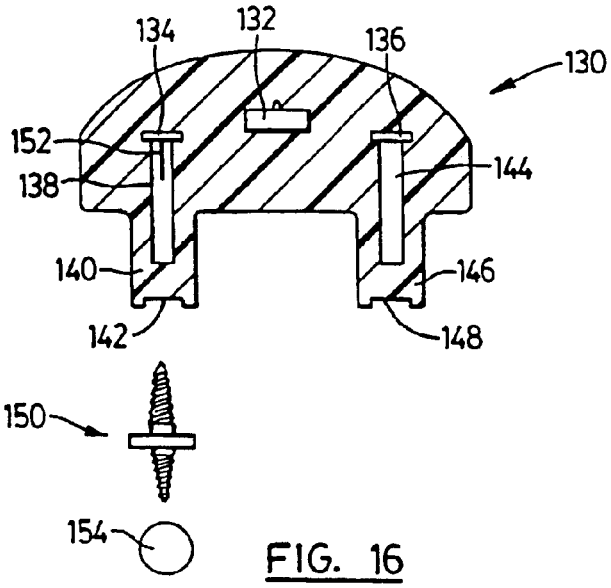
FIG. 16 is a schematic representation, in exploded view, of an alternate module of the invention.

FIG. 16 shows one alternate method of providing electrical connection between a module and an electrical conductor. Module 130 has LED 132 and associated electrical connectors 134 and 136. Each of electrical connectors 134 and 136 has a cavity associated therewith. Cavity 138 extends from electrical connector 134 down module leg 140 and terminates prior to recess 142 therein. Similarly, cavity 144 extends from electrical connector 136 down module leg 146 and terminates prior to recess 148. Recesses 142 and 148 are intended to retain an O-ring (not shown) to provide a seal with a connector pin, of which only connector pin 150 is shown. Connector pin 150 is intended to penetrate module leg 140 at recess 142 and connect with electrical wire 152 extending downwards from electrical connector 134 into cavity 138. Connector pin 150 is also intended to make electrical contact with electrical conductor 154. Connector 150 is shown as a screw, and would be screwed into module leg 140.

Another method of providing electrical connection is through use of induction coils. Embedded magnetic core and coiled wire are able to attract an induced voltage from a similar magnetic core and energised coiled wire in the connector block below. Each connector block is electrically connected to others via electrical cables disposed beneath said modules.

In use, the modules of the invention may be inserted in a continuous end-to-end manner so that a continuous light is obtained. Alternatively, some modules may be replaced with sensors, two way communication, (receiving and radiating, transmitting), intelligent or smart responsive, active, self-initiating, power generating or power storage devices. Some modules may not incorporate LEDs or may incorporate LEDs emitting a different coloured light than other modules. This may be provided by using tinted plastic material to provide the different colours, using lenses to provide different patterns or light direction, or by using LEDs of a different colour. Filler modules or sections may be used that do not provide light. Such filler sections may be, for example, reflective, luminescent, coloured white or opaque. In this manner, such markings as between lanes may be similar to that which is already typically found on highways with airports, with intermittent white or yellow lines. During dark or inclement weather, light may be emitted from the active LED modules. The active component would then emit the light providing increased safety and visibility.

As mentioned previously, other modules may be placed in the elongated lighting system for reasons other than providing lighting. All such other modules may be made in a similar fashion as the LED-containing modules. The modules providing lighting and other modules are both sufficiently robust to survive being placed in a road or airport taxiway and preferably have a convex curved cap or shape on a top portion to shed rainwater and, in conjunction with wheeled vehicles, would be self cleaning. Other modules may be placed in the elongated lighting system for other reasons. For instance, modules may be placed to detect localized weather conditions, traffic patterns, vehicle counts or to provide other functions.

Such a system of lighting and other modules may be interactive. Relevant information detected by the system may be broadcast and transmitted to interested parties and users. Similarly, instructional information broadcast to, and received by the system would precipitate action (i.e., a sensor, module might detect a traffic jam, or freezing bridge). These circumstances may then be communicated to all interested users and authorities as a warning message. The intelligent or smart sensor module or modules may be preprogrammed to autonomously change the colour of the LEDs on a freezing bridge section. However, on receiving instructions via a broadcast signal from a local transportation authority they would start the lighting system flashing, to warn drivers of possible hazards, or close or clear lanes for emergency vehicles. A variety of sophisticated modules having different functionality may be incorporated into any system in a modular fashion, to customize the system to an end user's requirements.

The system may be as simple as providing guidance lighting only, or be fully computerised and interactive. The system may include communication devices, for instance infrared, microwave, radio or other wavelengths suitable for communication, LED or other light sources. Such communication devices, which may transmit analog or digital data, would allow motorists and regulatory authorities (e.g., police) to receive data on road conditions and preferably do so in real time. The transmissions may be unidirectional or multidirectional. The electrical conductors used for the modules described herein may provide the power for such alternate modules. The communication to and from such modules may be incorporated as transmitters and receivers within the modules themselves, or in particular, wiring, fibre optics or other communication devices, for such alternate modules may pass through the channel system, as disclosed herein for use with the elongated lighting system of the invention, or alternatively may not be involved with the system, but just use the channel system for a right of way. Thus, the modular aspect of the invention provides a high degree of flexibility in use of the elongated lighting system for a variety of reasons. Alternatively, or in conjunction with regular powered modules, there may be replaceable modules designed to generate and store the needed electricity. The generation of electricity may be accomplished via induction methods, whereby embedded coils, manufactured by injection moulding, extrusion or casting process, at right angles to an electric current would have electricity induced within them. Other panels may be similarly embedded, in the plastic of an elongated lighting system, the channel portion of the module or mounted at within a specialized channel in the road. Other panels mounted at the side of the road or taxiway may generate needed electricity. The power storage devices may be similarly manufactured, encased and mounted. If the side of road or taxiway was used, then other forms of electrical generation such as solar, wind, water, or fuel or a combination thereof may be used to generate co the needed electricity.

Back-up power and electrical storage capacity may be provided by batteries or other electrical storage devises either similarly encapsulated or separately mounted at the side of the road, taxiway etc. These types of generator/storage modules would be modular and designed to provide specific LED concentrations with power. They may act as back up power supplies in emergencies, or to power LED and other smart modules in remote locations, where no main power was available. They may be placed between the active LED modules such that the markings on a road between lanes may be similar to that which is typical on highways or airports with intermittent white or yellow lines.

It is contemplated that an elongated lighting system may include a plurality of modules of specified length arranged end-to-end, the modules being energised and having a plurality of LEDs on an elongated support. The LEDs may be connected to a pair of electrical conductors having a length equal to or less than the discrete length of the module. The modules may be moulded with the LEDs, elongated support and electrical conductors embedded in transparent, opaque, semi-transparent or mixed transparent and opaque plastic. In addition, the modules may include permanent or electrical induced magnets. The modules may include radar reflective or absorbing materials, with lights or electronics similarly embedded to provide the guidance for machine vision, or computer controlled or automated vehicles.

Such an elongated lighting system may have embedded internally or externally a portion of an induction current generating system to produce an electric current via induction in a vehicle, via a magnetic electric, or electronic collection assembly, within or external to a vehicle passing close to or over an induction current system for powering said vehicle as well as providing via signal or other means guidance for said vehicle and/or levitation of said vehicles.

The elongated line of light, as provided in the present invention, is more visible from greater distances in a greater variety of weather conditions than a traditional point source of light (e.g., from an overhead lighting system or passive reflectors, "cats eyes") on the road. In addition, it is more visible than traditional white or yellow-painted lines on a pavement, particularly at times of inclement weather. The system also provides flexibility in installation, for a variety of uses. Intelligent or smart module systems, as customized by end users could detect and notify users of potential hazards. These types of systems may also receive instructions and take pre-programmed actions to increase viewer safety. The system also provides flexibility in installation. For instance, the typical installation will be accomplished by forming a groove in a pavement surface, into which the elongated lighting system is placed. A channel system is placed in the groove and modules placed into the channel system in a desired pattern. However, as disclosed herein, the elongated lighting system may be placed on the surface of the pavement, and anchored by convenient means (e.g., by providing spikes through orifices or an alternate channel system). In this manner, temporary lighting may be installed on roadways, construction sites or other areas to assist in guidance and safety of traffic. This is of particular importance at night in construction areas, on roadways where temporary lane systems are used, often involving a variety of directional changes for a driver, in short distances.

Most end-use environments impose rigid specifications on the ability of an elongated lighting system to be used. For instance, roadways and airport runways in snow-belt locations have to be cleared of snow, subjected to sanding, and/or sprayed with salt or other compositions to keep the pavement in a safe, useable (navigable) condition. The use of a flush or low profile lighting system as disclosed herein reduces the likelihood of damage by equipment involved in clearing of the pavement surface of snow or ice. Similar requirements are encountered in dusty arid areas where brushes have to be used. Furthermore, in normal use, a linear lighting system embedded flush with the surface is not subjected to the full loading of a vehicle passing over the lighting system, as a substantial part of the load is still carried by the surrounding pavement.

The lighting system of the present invention provides linear light guidance. Linear light guidance tends to be preferable to point light guidance, in that a line can provide substantially more information to persons viewing the lighting system. For example, unlike point sources, which need to be aligned and have to have a number of them visible at the same time, a single lit linear section of the lighting system, as disclosed herein, would provide both positional and directional information and when of a known length would provide range information. A driver viewing a number of linear lit sections should normally receive help in depth perception at night. The information provided to the viewer would not only act as a guidance indicator (e.g., the linear lighting system shows the position of the lanes on a road), but may also aid in providing some or all of depth perception information, correct direction information, perspective, speed, range information and the like.

The lighting system is lit (i.e., it is powered and not just reflective as with reflectors or "cats eye" road studs). Thus a viewer is able to see the system as far as visibility permits. This would be beneficial in adverse weather conditions, including snow, rain and fog. Since the system can be seen as far as visibility permits, it would provide guidance at far greater viewing distances than a series of reflectors. Consequently, a viewer should have much earlier opportunities to appreciate and act upon the guidance (as in curves and hazards) leading to increased viewer time to react thereby contributing to safety. These advantages are provided with less light output than traditional street lights, providing energy savings and thereby reducing night-time glare, and causing less light pollution. In addition, intelligent or smart module systems, as customised by end users, would detect and notify users of potential hazards. These types of systems may also receive instructions and take pre-programmed actions to increase viewer safety.

Linear guidance reduces the likelihood of confusion, and may be combined with directional devices to reduce hesitation. It is believed that night-time direction is interpreted more readily, as the viewer sees the whole lit line system as a unit, rather than an individual or a few series of reflected points of light. If point lights are used close together, a viewer can get a sense of direction, but for economical reasons these points are normally spread out and consequently tend to be less readily understood. Point lights can also be confused with other lights in the background, particularly if the road is wet and reflects street, building or other lights.

The light output value of a line is believed to be cumulative, with many lit sections being viewed at the same time. Thus, the system appears brighter than might otherwise be interpreted for a single light source.

The directional control of the light in the system is important for the economics of the system, as less LEDs should be required for a given visibility. Moreover, the present invention is versatile, as it is capable of being manufactured so that most of the light is viewed in one or more directions, depending on the angle of orientation of the LEDs, or the use of lensed, or light directional systems. For example, a lateral twist and/or longitudinal bending, imposed on the heat sink in manufacture, will direct most of the light in the direction of the lateral twist or bend. Similar effects may be achieved with the use of lensed, or light directional systems. Critical situations, for example pedestrian cross walks, require low visibility in a linear direction, but a high visibility in a lateral direction, so that the cross walk is very visible to an approaching automobile.

The system has flexibility in the choice of components. Changes in LED shape, numbers, colour or the use of other types of light or electronic systems may all be accommodated by the system. Modules of various lengths may be manufactured with a variety of characteristics and installed in a variable sequence to provide a wide variety of guidance, information and the like, including information to motorists and to authorities administering the road (e.g., police, Departments of Transportation or other regulatory body etc.). It is also contemplated to link to the system current traffic control devices or the like.

The system may incorporate or be connected to sensors, smart modules or the like to determine a wide variety of traffic conditions (e.g., stalled or slow traffic, accidents, weather, temperature, barometric pressure, fog and ice). The system may include communication devices, for instance infrared, microwave, radio or other wavelengths suitable for communication, LED or other light sources. Such communication devices, which may transmit analog or digital data, would allow motorists and regulatory authorities (e.g., police) to receive data on road conditions and preferably do so in real time. The transmissions may be unidirectional or multidirectional. The latter would allow mobile or static police, fire, ambulance or military or other authorities to communicate via the modules, within a particular location, to motorists to clear lanes for emergency vehicles, or for other reasons. In addition, the communication devices may communicate with any and all wireless receivers for individual information and up-dates on road conditions for the immediate location or for distant locations. It would thus be possible to obtain road information for a proposed route, and enable alternative routes to be selected well in advance of anticipated problems. The sensors or smart modules may communicate with global positioning systems, for communication to motorists of information on an individual customized route plan selected by a motorist. The system may also incorporate magnetic or radar reflective sections, or other reflective sections, for use in guidance of machine vision vehicles (e.g., vehicles guided by means of such reflective devices). Magnetic or other devices may be incorporated to power and/or lift vehicles.

Smart segments may also flash the LED lamps within a section, or even the individual LEDs, in response to an authorized order from police etc. to help clear a lane or slow traffic for some reason, or may be set to automatically function in a prearranged fashion once a hazardous situation, fog, accident, icing of a bridge etc. was detected.

The system allows for sophisticated connectors, which are usually the weakest link in the system, and permits continued operation even if one module should fail. The LEDs have the ability to withstand extreme physical and chemical conditions, including the weight of aircraft and other vehicles, corrosive materials especially salt and sand, summer and winter temperatures, impact at low temperatures and the like.

The system is versatile in the potential end-uses. For instance, it may be useful in marine, mining, explosive, aggressive, difficult maintenance and bad weather areas, where traditional lighting systems can be difficult to install and maintain, and also tend to be unreliable. The system is rugged, is mobile for emergency or other use, as in helipads, and with solar, wind or other forms of power generation, may be installed in areas that have no grid power, or are difficult to access such as signs on high rise buildings, or mining and other elevator shafts (e.g., the elevator shafts used for the transportation of goods or bringing up explosives and munitions in the military).

The system has low power consumption, and in some instances may be operated using solar power. The system has low maintenance, a long life, is economic and environmentally acceptable. Use of solar power would make the system useful for emergency guidance lighting in remote locations.

The system should provide for the increases in safety, especially at night and in adverse weather conditions. This is important in view of current population demographics with the ageing of society, as night vision becomes much more difficult as a person ages.

We claim:

1. An elongated lighting system which comprises a plurality of modules of discrete length arranged end-to-end, said modules being energized by an induced voltage using an embedded magnetic core and coiled wire, said modules having a plurality of LEDs on an elongated support, said LEDs being connected to electrical conductors having a length not exceeding the discreet length of the module, said modules being moulded with the LEDs, elongated support and electrical conductors being embedded in at least one of transparent, opaque and semi-transparent plastic material.

2. An elongated lighting system comprising:

a channel member including electrical source connectors; and one or more elongated lighting module sized and shaped to be receivable within said channel member, each of said one or more elongated lighting module including a plastic enclosure, said moulded plastic enclosure encapsulating an elongated support including one or more light-emitting devices positioned on said elongated support and electrical source connectors connected to said one or more light-emitting device and extending from said plastic enclosure so as to make contact with said electrical source connectors, wherein said channel member includes a central support and said electrical source connectors are separated from each other by said central support.

3. The system of claim 2 wherein said channel is embedded below grade.

4. The system of claim 2 wherein said channel is anchored above grade.

5. The system of claim 2 wherein said channel member includes a pair of spaced grooved respectively formed on opposite sides of said central support.

6. The system of claim 5 wherein said plastic enclosure includes a pair of spaced legs which are sized and shaped to fit into said pair of spaced grooves.

* * * * *